US005951129A

United States Patent [19]

Stein

[11] Patent Number: 5,951,129

[45] Date of Patent: Sep. 14, 1999

[54] TOOL-BOX

[76] Inventor: Brad A. Stein, 4555 SW. 142nd Ave., #151, Beaverton, Oreg. 97005

[21] Appl. No.: 09/002,744

[22] Filed: Jan. 5, 1998

[51] Int. Cl.[6] ..... B65D 85/00

[52] U.S. Cl. ..... 312/249.13; 312/107; 312/328; 312/280; 206/373

[58] Field of Search ..... 312/277, 292, 312/249.8, 108, 111, 107, 327, 328, 280, 249.13; 206/373, 372; 211/70.6

[56] References Cited

U.S. PATENT DOCUMENTS

| | | | |
|---|---|---|---|
| 1,987,822 | 1/1935 | Gregory | 206/373 X |
| 2,286,427 | 6/1942 | Levensten . | |
| 2,525,208 | 10/1950 | Clink | 206/373 X |
| 3,092,428 | 6/1963 | Kerschner . | |
| 3,520,583 | 7/1970 | Case | 312/249.13 X |
| 4,108,514 | 8/1978 | Zimmerman | 312/107 |
| 4,211,455 | 7/1980 | Tedrow | 312/198 |
| 4,303,158 | 12/1981 | Perkins . | |
| 4,614,384 | 9/1986 | Takano et al. | 312/277 X |
| 4,733,703 | 3/1988 | Cimino . | |
| 4,821,143 | 4/1989 | Holmgren et al. . | |
| 4,826,007 | 5/1989 | Skeie | 206/373 |
| 4,840,273 | 6/1989 | Zavacki . | |
| 5,152,406 | 10/1992 | Kling et al. | 211/70.6 |
| 5,152,441 | 10/1992 | Torena . | |
| 5,207,723 | 5/1993 | Newby, Sr. | 312/290 X |
| 5,221,132 | 6/1993 | Combs et al. . | |
| 5,244,265 | 9/1993 | Chiang . | |
| 5,378,005 | 1/1995 | Norton . | |
| 5,398,810 | 3/1995 | Wang . | |
| 5,456,358 | 10/1995 | Schmidt . | |
| 5,482,162 | 1/1996 | Dickinson . | |
| 5,588,659 | 12/1996 | Boes et al. . | |
| 5,645,332 | 7/1997 | Snoke et al. . | |
| 5,772,047 | 6/1998 | Bostjancic | 211/70.6 X |

*Primary Examiner*—Peter M. Cuomo
*Assistant Examiner*—Hanh V. Tran
*Attorney, Agent, or Firm*—Robert L. Harrington

[57] ABSTRACT

A tool-box. An upper and lower module are provided wherein the upper module extends laterally beyond the lower module so as to form an overhanging portion in the upper module. The overhanging portion includes apertures adapted to pass the shanks of elongate tools and retain handle portions thereof, thereby securing the tools while permitting the shanks to hang outside of both modules. The upper module includes a door adapted to swing upwardly, out of the way of the user, to an open position. The door includes hinged side portions that are adapted to swing upwardly, out of the way of the user when the door is in the open position.

5 Claims, 3 Drawing Sheets

TOOL-BOX

BACKGROUND OF THE INVENTION

This invention relates to tool-boxes, particularly tool-boxes adapted for use by the professional mechanic, such as the professional automobile mechanic.

Professional mechanics, particularly when paid a flat-fee for their work, seek to decrease the time they must spend on the job. A good tool-box can make a significant contribution to saving time by providing organized, at-hand storage of tools needed on the job. However, the number and variations in size and shapes of such tools present storage and retrieval difficulties. The weight and size of the tool-box has hindered its mobility. Moreover, the high cost of professional tools imposes a requirement for safe and secure storage. Meeting all of these requirements in a tool-box has generally come at a high cost.

The typical, prior art, tool-box preferred by many professional mechanics is known variously as a "roll-away cabinet", "roller chest" or "roller cart" (hereinafter "roll-away cabinet"), which is an enclosure about 3½ feet tall mounted on casters and containing a plurality of drawers running the width of the cabinet. The drawers are typically lockable. Some of the drawers are of narrow height, for storing elongate tools such as wrenches and screwdrivers in a horizontal orientation, and some of the drawers are of greater height, for storing tools and supplies of greater bulk. Sometimes the roll-away cabinet is provided with a separable upper storage unit that runs the width of the roll-away cabinet but does not extend all the way to the front surface thereof, leaving a small ledge for temporarily placing items while working.

The roll-away cabinet possesses the advantage that it allows the tools to be relatively easily moved from one place to another, by rolling the cabinet. However, the cabinet also has some notorious drawbacks. It is difficult to keep tools, especially elongate tools, in neat order when placed in drawers, the tendency being to pile tools on top of tools. Further, it is difficult to maintain order as the tools are jostled about by opening and closing the drawers. Further still, the entire weight of all of the tools in the drawer must be carried by the drawer every time it is opened and closed. For this reason, roll-away cabinets are provided with heavy-duty drawer slides, which adds significantly to their cost. Once a drawer is opened for accessing the tools, the cabinet takes up more space. If the drawer is left open, it can be run into and thereby cause injury. Therefore, the drawer must generally be repeatedly closed and opened, making access to tools more time consuming and difficult.

Schmidt, U.S. Pat. No. 5,456,358 ("Schmidt"), proposes a TOOL BOX which addresses some of the above problems. Schmidt includes structures in the upper portion thereof for holding tools in designated positions. For example, a first row of pegs is attached to a back portion, the pegs being used to hold elongated tools which have apertures that allow them to be disposed about the pegs. An upper end of the pegs contacts or is in close proximity to a horizontal section of a cover when then the cover is in its closed position. Thus, an elongated wrench disposed about the peg is held in place and prevented from movement within the tool box because of the closure arrangement.

One drawback of the Schmidt device is that, unless it is placed on a work-surface that raises its height, the mechanic must generally stoop to reach the tools inside. Also, Schmidt does not propose a feature of the tool box that would facilitate moving the tool box from one location to another.

In particular, if the tool box is placed on a typical work-surface it is not generally easily moved to another work-surface.

Boes et al., U.S. Pat. No. 5,588,659 ("Boes") proposes a TOOL CART which provides tool supports in a frame extending vertically from a generally horizontal work bench, and a wheel assembly. The wheel assembly facilitates moving the tool-cart from one location to another, though the entire weight of the loaded cart must be raised in order to tilt it so as to operably engage the wheel assembly with a supporting surface. The tool supports appear to be provided at a height sufficient so that a user need not stoop to reach tools stored through apertures therein. Further, the tool supports are enabled to pivot outwardly to an angulated position so that they may be positioned transversely of the frame. But while the angulated positioning in Boes provides for a degree of improvement in access to the tools, it comes at the cost of increased mechanical complexity. Moreover, to the extent that the tool supports are positioned transversely of the frame as proposed, a user standing in front of the work bench and wishing to remain there is required to reach over a significant span to grasp a tool. Additionally, this will generally make it more difficult for the user to pull the tool upwardly out of its aperture, to release the tool from the support.

Accordingly, there is a need for a tool-box that provides for portably and securely storing a plurality of mechanic's tools so as to maximize the introduction and maintenance of order in the stored tools as well as improving access thereto, at a minimum cost.

SUMMARY OF THE INVENTION

The present invention solves the aforementioned problems and meets the aforementioned needs by providing a tool-box having an upper module attached to a lower module, wherein the upper module is arranged to extend laterally beyond the lower module so as to form an overhanging portion of the upper module. In a particular embodiment of the invention, the overhanging portion includes apertures adapted for receiving the shanks of elongate tools and for retaining handle portions thereof, so that the shanks are permitted to hang downwardly below the overhanging portion, outside the upper module and outside the lower module, while the handles are securely contained within the upper module.

In another embodiment of the invention, the upper module includes a housing that has a substantially vertically oriented back portion, a relatively deep, horizontally oriented bottom portion, a relatively narrow, horizontally oriented top portion, and a pair of substantially parallel side portions which connect the back, bottom and top portions. The side portions are relatively narrow where they attach to the top portion and are relatively deep where they attach to the bottom portion, so that front edges of the side portions slope away from the user at an access opening of the housing to improve accessibility to the tools. A door is hingedly connected to the top portion so as to swing vertically upwardly, out of the way of the user, and closes along the front edges of the side portions. Preferably, the door includes hinged side enclosures adapted to swing up, out of the way of the user, to further improve accessibility.

Accordingly, it is a principal object of the present invention to provide a novel tool-box.

It is another object of the present invention to provide such a tool-box that provides for portably and securely storing a plurality of mechanic's tools so as to maximize the introduction and maintenance of order in the stored tools as well as ease of access thereto, at a minimum cost The foregoing and other objects, features and advantages of the invention will be more readily understood upon consideration of the following detailed description of the invention, taken in conjunction with the following drawings.

DETAILED DESCRIPTION OF A PREFERRED EMBODIMENT

Figure 1:
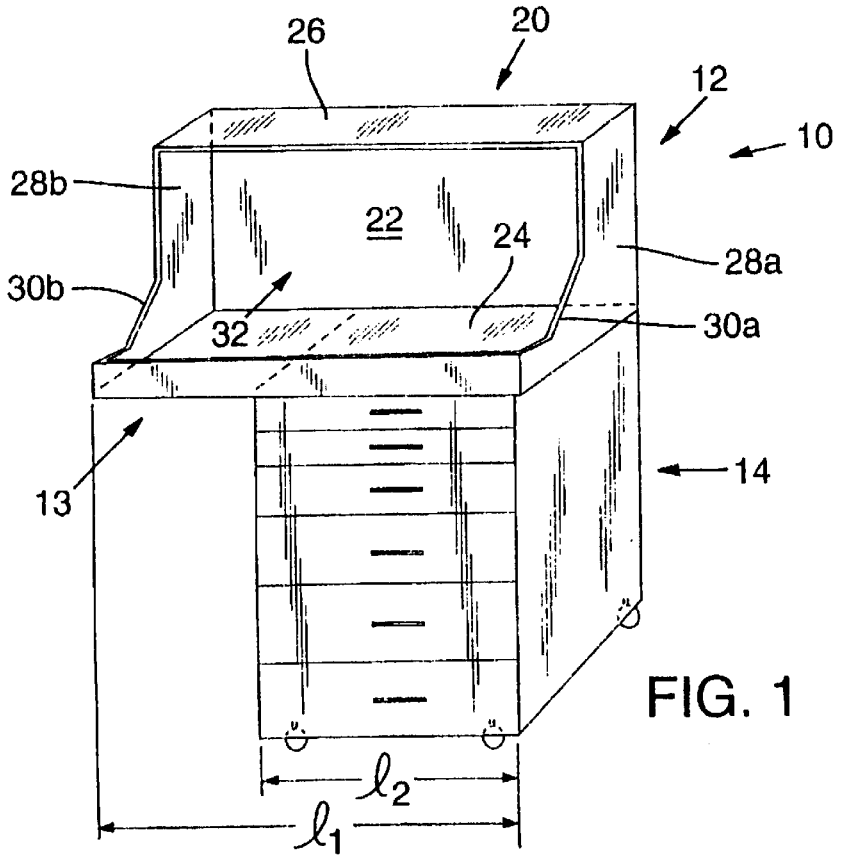
FIG. 1 is a pictorial view of a tool-box according to the present invention.

FIG. 1 depicts an embodiment of a tool-box according to the present invention. A tool-box 10 has an upper module 12 sometimes referred to as an upper tool box and a lower module 14, wherein the upper module is arranged to extend laterally beyond the lower module so as to form an overhanging portion 13 of the upper module. The lower module 14 functions as a support stand for the upper module or tool box 12. Preferably, this is accomplished by providing the upper module with a lateral width dimension "$1_1$" that is greater than the corresponding lateral width dimension "$1_2$" of the lower module 14. However, the upper module may have a lateral width dimension that is the same size or smaller than the corresponding lateral width dimension of the lower module, for example, wherein the upper module is displaced with respect to the lower module to form the overhanging portion 13, without departing from the principles of the invention. The provision of the overhanging portion 13 provides for an outstanding advantage of the present invention which will be discussed below. Both the upper and lower modules are preferably adapted for storing tools in the interiors of the modules.

Figure 2:
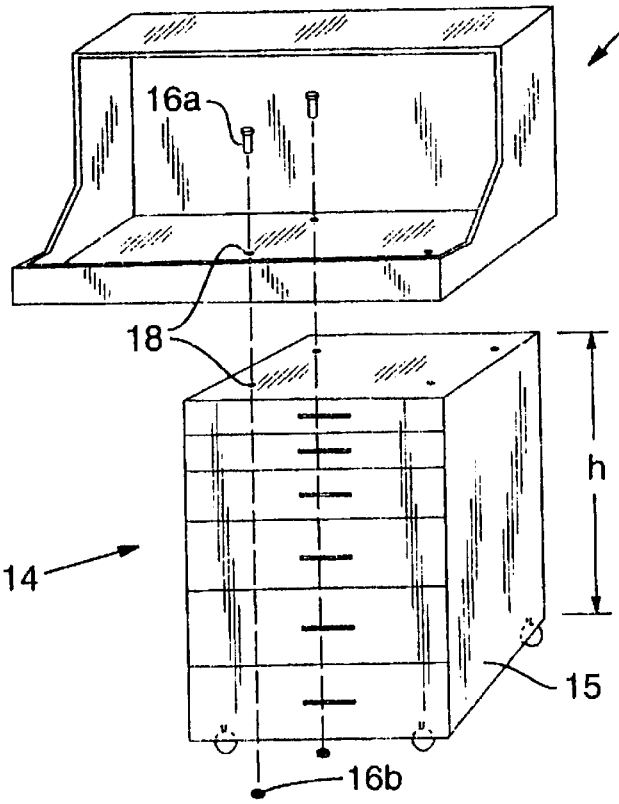
FIG. 2 is an exploded view of the tool-box of FIG. 1, wherein an upper module is shown ready for attachment to a lower module according to the present invention.

The upper and lower modules 12 and 14 may be manufactured together and may be integrally formed. However, referring to FIG. 2, it has been found most advantageous to employ a prior art roll-away cabinet 15 as the lower module 14 and attach the upper module 12 to the cabinet by suitable fasteners such as screws 16*a* passing through apertures 18 and receiving nuts 16*b*. The apertures 18 may be provided in the cabinet as purchased, but may also be drilled or otherwise provided by the user after purchase. However, any suitable fastening means for fastening the below described upper module 12 to a lower module 14 may be employed without departing from the principles of the invention. Standard roll-away cabinets are generally found to provide a vertical height "h" for the upper module 12 that is desirable for achieving easy access to tools stored in the upper module without requiring the mechanic to bend over, however, lower modules 14 having greater or lesser heights may be employed without departing from the principles of the invention.

Referring back to FIG. 1, the upper module 12 includes a housing 20 having a substantially vertically oriented back portion 22 and an access opening 32 bounded by a relatively deep, substantially horizontally oriented bottom portion 24, a relatively narrow, substantially horizontally oriented top portion 26, and a pair of substantially parallel side portions 28*a*, 28*b* which connect the back, bottom and top portions. The side portions are relatively narrow where they attach to the top portion and are relatively deep where they attach to the bottom portion. Thence, front edges 30*a*, 30*b* of the side portions generally fall away from a user facing the access opening 32, to increase side-accessibility to the interior of the housing 20, and to provide for a larger access opening.

Figure 3A:
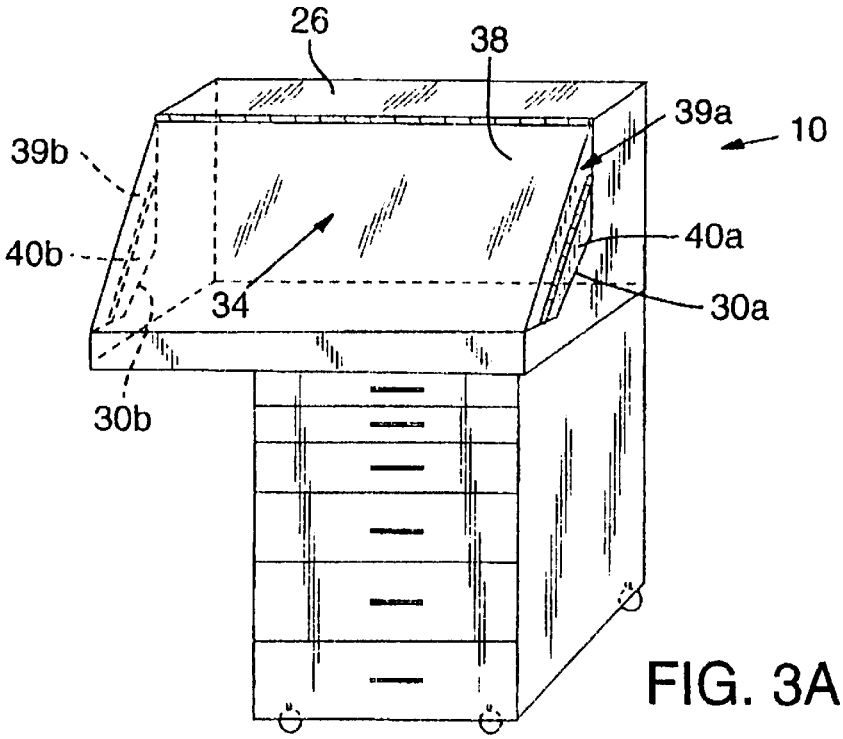
FIG. 3A is a pictorial view of the tool-box of FIG. 1, including a door and movable side enclosures according to the present invention shown in closed positions.
Figure 3B:
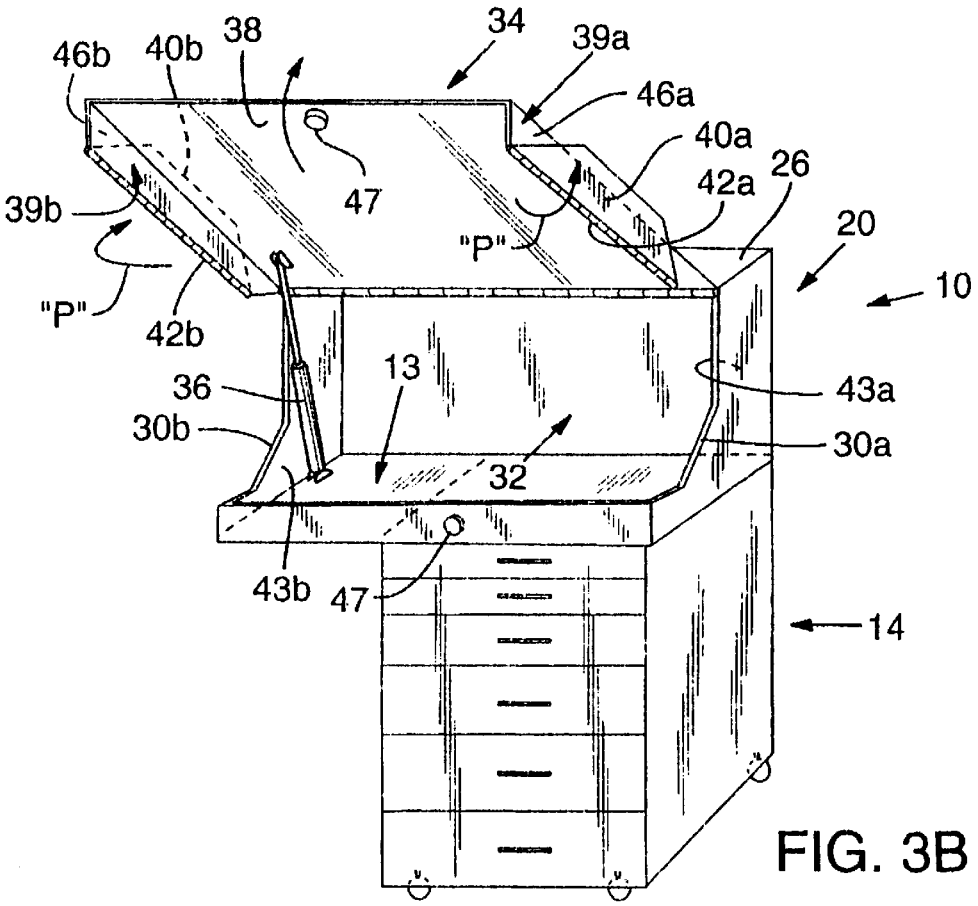
FIG. 3B is a pictorial view of the tool-box of FIG. 3A, wherein the door and movable side enclosures are shown open positions.

Turning now to FIGS. 3A and 3B, a door 34 is hingedly connected to the front of the top portion 26. The door is adapted to assume a closed position in which the door covers the opening 32 and by which the upper module is substantially completely enclosed. The door is further adapted to swing vertically upwardly, out of the way of the user, to assume an open position in which the opening 32 is not covered and providing access to the tools stored inside the housing. Preferably, the housing includes retention mechanisms, such as one or more gas struts 36, to maintain the door in its open position.

Preferably, the door 34 includes a cover portion 38, side portions 39*a*, 39*b* and movable side enclosures 40*a*, 40*b* that are hingedly connected to the side portions. The side enclosures are movable between open and closed positions. As best seen in FIG. 3A, the side enclosures, in closed positions thereof, complete the dimensional span of the side portions and are sized and shaped so as to substantially continuously overlap the front edges 30*a*, 30*b* when the door 34 is in its closed position. Respective hinges 42*a*, 42*b* connecting each side portion to the cover portion 38 are adapted to pivot in a pivot direction and not to pivot in the opposite direction. In general, the side enclosures and door are dimensioned and positioned so that the side enclosures overlap the front edges, and the hinges are attached to the cover portion so that the pivot direction faces the side portions 28*a*, 28*b*. Thence, when the door is closed, the side portions block pivoting of the side enclosures in the pivot direction and the resistance of the hinge prevents pivoting in the opposite direction, thereby locking the side enclosures in their closed positions. It is preferable to select the pivot direction "P" to face away from the housing 20, and to position the side enclosures so that they overlap the front edges at inside surfaces 43*a*, 43*b* of the front edges. The door includes a standard lock 47 fitted between the cover portion and the bottom portion to securely maintain the door and the side enclosures in their closed positions, when this is desired.

As best seen in FIG. 3B, in their open positions, the side enclosures 40*a*, 40*b* are preferably permitted by the hinges 42*a*, 42*b* to pivot substantially 180 degrees until they come into contact with adjacent sides 46*a*, 46*b* of the cover portion 38. Providing for this high degree of pivoting is preferable to maximize access to the interior of the housing 20 while at the same time permitting the opened door 34 to occupy a minimum space.

As mentioned above, the upper module 12 extends laterally beyond one side edge of the lower module 14 to form an overhanging portion 13 of the upper module overhanging a drop-off spacing outwardly of the side edge of the lower module 14. The overhanging portion depicted in FIGS. 1–3B is associated with the side portion 28*b* of the housing 20. However, the overhanging portion may have different configurations and be associated with different portions of the housing 20, and there may be more than one overhanging portion. As just one example, there may be two, substantially symmetrical overhanging portions wherein each is identified with one of the side portions 28*a* and 28*b*. This configuration is depicted by the alternative embodiment shown in FIG. 4.

Figure 4:
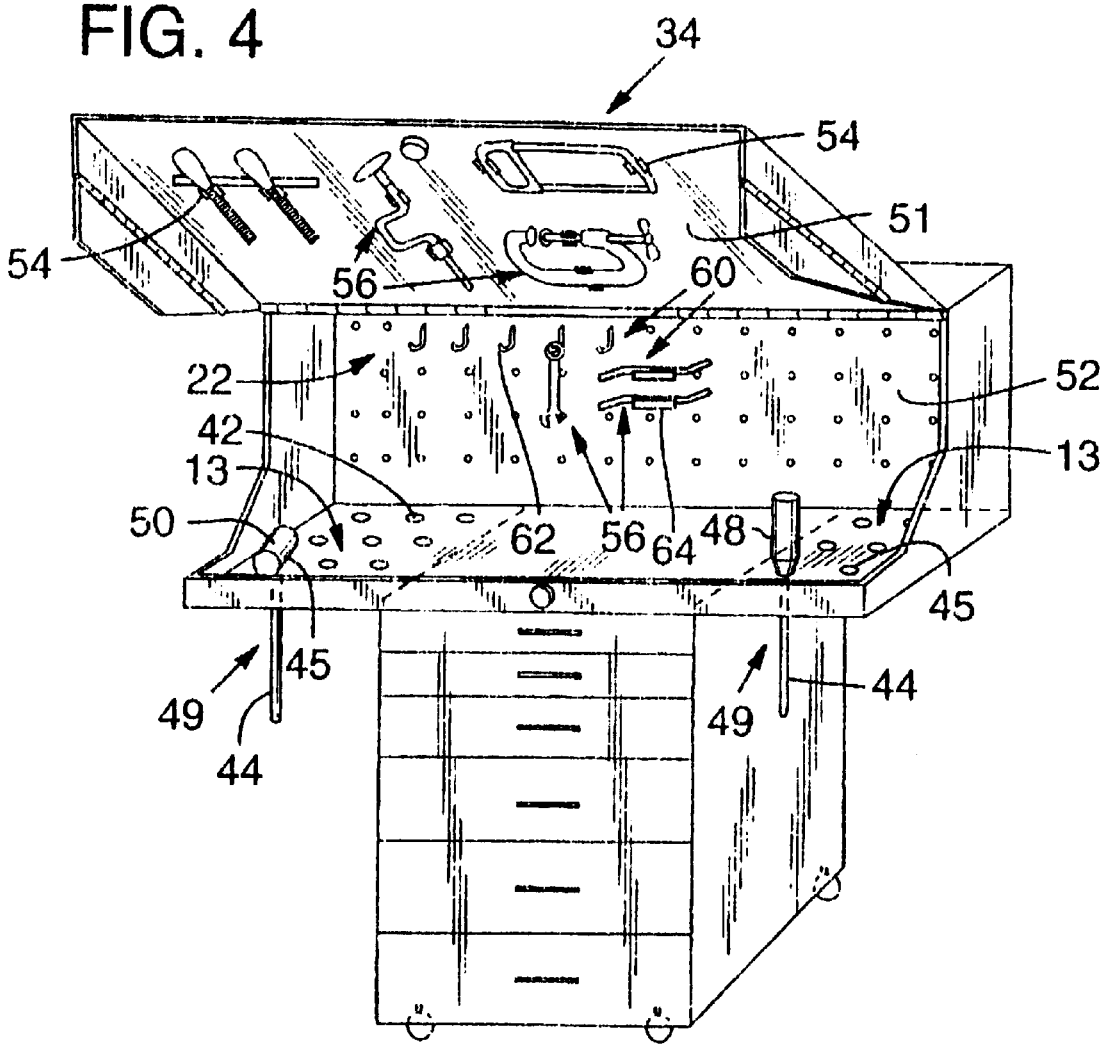
FIG. 4 is a pictorial view of an alternative tool-box according to the present invention, showing an exemplary plan of tool storage therein.

Referring particularly to FIG. 4, the overhanging portions include apertures 45 adapted for receiving the shanks 44 of elongate tools 49 and for retaining handle portions 48 of the tools, such as the handle of a screwdriver, or widened portions 50 of the tools, such as the socket receiving end of a ratchet or the prying end of a crow-bar. Such handle portions and other widened portions are collectively referred to as head portions of the tools. The apertures 45 provide for an outstanding advantage of the present invention. Narrower portions of the tools may be passed through the apertures 45 to become disposed outside of both the upper and lower modules while wider portions of the tools are kept by the apertures within the confines of the upper module 12, so that the tools are secured by closing and locking the door 34 even though portions of the tools remain unprotected and uncovered by sheet metal. As a result, less sheet metal is required to securely house elongate tools than has heretofore been required, resulting in a substantial savings in both weight and cost. At the same time, the tools are stored in a most orderly fashion, and are held for presentation to the user in a manner that substantially enhances access thereto.

Preferably, an aperture 45 is adapted to retain a particular tool 49 by being provided a circular configuration having a diameter that is larger than the widest dimension of a narrower portion of the tool, but that is smaller than the narrowest dimension of a wider portion of the tool. Then, the tool cannot be removed through the aperture from the outside of the upper module.

While the overhanging portion 13 with the circular apertures 45 as just described is the preferred structure for retaining tools with the upper module 12, other retentive means may be employed without departing from the principles of the invention. For example, an aperture may be particularly dimensioned and shaped for retaining a particular tool when it is fitted through the aperture in a particular orientation. Moreover, any suitable hardware known in the art may be attached to the overhanging portion 13, wherein the hardware is adapted to capture the tools partially or completely underneath the overhanging portion. The hardware may further provide for locking the tools and for releasing the tools from inside the module 12 or from the outside.

The door 34 is preferably adapted to store tools on an inside surface 51 thereof. As the weight of the door must be overcome and sustained to move the door into and maintain the door in its open position, it is preferable that a relatively small quantity of lighter weight tools be stored on the inside surface 51. Means 54 known in the art for attaching tools or other objects 56 to the inside surface 51, such as hooks, clasps and clamps, are attached thereto for this purpose. The means 54 should be adapted to retain the tools throughout the range of movement of the door.

The back portion 22 is also adapted to store tools on an inside surface 52 thereof. Means 60 known in the art for attaching tools or other objects 56 to the inside surface 52, such as pegs 62 and ledges 64, are attached thereto for this purpose. An advantageous material out of which the back portion 22 may be formed is peg-board.

It is to be recognized that, while a particular tool-box according to the present invention has been shown as preferred, other configurations could be utilized, in addition to configurations already mentioned, without departing from the principles of the invention.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

I claim:

1. In combination a tool box and a support stand comprising:

a support stand including a support bottom for supporting the support stand on a shop floor, a support top elevated above the support bottom at a determined height above the floor, and a brace member rigidly supporting the support top above the support bottom, said support top having a substantially horizontal support surface having at least one side edge defining a drop-off spacing laterally outwardly of and below said one side edge;

a tool box having front, back and opposing side walls and a bottom which define a tool retaining interior, and a closable top for closing and opening the top for selectively securing the interior of the tool box and exposing the interior of the tool box, respectively, said interior of the tool box having first and second laterally adjacent interior portions;

said tool box and said support stand cooperatively configured with said tool box supported on said support top with said first interior portion positioned over said support top inwardly of said side edge and said second interior portion positioned outwardly of said side edge and suspended over said drop-off spacing; and apertures provided in the bottom of the tool box in said second interior portion, said apertures configured and sized to receive shank portions of tools having head portions retained in the tool box interior with the shank portions suspended through the apertures and into the drop-off spacing, said tools retrievable with the top in the open position and said tools secured in the tool box with the top in the closed position.

2. A tool box and support stand as defined in claim 1 wherein fasteners fasten the tool box to the support top of the support stand.

3. A tool box and support stand as defined in claim 1 wherein the support stand is a tool chest, said brace member comprised of side walls of the tool chest, and a front wall fitted with drawers to hold tools.

4. A tool box and support stand as defined in claim 3 wherein the tool chest is provided with casters for moving the tool chest and tool box supported thereon along a shop floor.

5. A tool box and support stand as defined in claim 1 wherein:

the back wall has an upper edge at a substantially greater height than an upper edge of the front wall and the side walls are configured to have an upper edge extended downwardly from the back wall upper edge to the front wall upper edge, and said top when closed extended angularly forwardly and downwardly from a hinge connection at the back wall upper edge to the front wall upper edge and having side edges in mated engagement with said side wall upper edges, and said top when opened extended angularly upwardly and forwardly from the hinge to suspend the weight of the top over the interior of the tool box;

said top having an inner surface, tool attachment devices provided on said inner surface for holding tools to said inner surface; and a retention mechanism extended between the top and one of the interior defining components for retention of the top in the open position.

* * * * *